US005494096A

United States Patent [19]

De Antonio Gonalons et al.

[11] Patent Number: 5,494,096

[45] Date of Patent: Feb. 27, 1996

[54] INVESTMENT CASTING PROCESS

[76] Inventors: Juan De Antonio Gonalons; Ricardo Insausti Martinez De Lahidalga, both of C/Villanueva, 31-1° Drcha, Madrid 280001, Spain

[21] Appl. No.: 225,644

[22] Filed: Apr. 11, 1994

[30] Foreign Application Priority Data

Apr. 13, 1993 [EP] European Pat. Off. ..... 93500042

[51] Int. Cl.[6] ..... B22C 7/02; B22C 9/04

[52] U.S. Cl. ..... 164/516; 164/36; 164/45

[58] Field of Search ..... 164/34, 35, 36, 164/45, 516

[56] References Cited

U.S. PATENT DOCUMENTS 3,610,314 10/1971 Hochgraf ..... 164/27

5,072,770 12/1991 Yodice ..... 164/34

5,247,984 8/1993 Stanciu ..... 164/35

*Primary Examiner*—P. Austin Bradley

*Assistant Examiner*—Randy Herrick

*Attorney, Agent, or Firm*—Ben D. Tobor

[57] ABSTRACT

An investment casting process utilizes a temporary mold which is formed by pouring a liquid over a positive pattern, and cooling the liquid until it solidifies. The positive pattern is removed, and a temporary pattern is formed by pouring another liquid into the cavity of the temporary mold, and cooling the second liquid until it solidifies. The temporary mold may then be melted or dissolved to leave a temporary pattern, which may be coated with a ceramic slurry to form a ceramic shell. The temporary pattern may then be melted or dissolved in order to remove the temporary pattern from the ceramic shell. The ceramic shell may be filled with molten metal which is allowed to solidify to form the final cast piece.

10 Claims, 5 Drawing Sheets

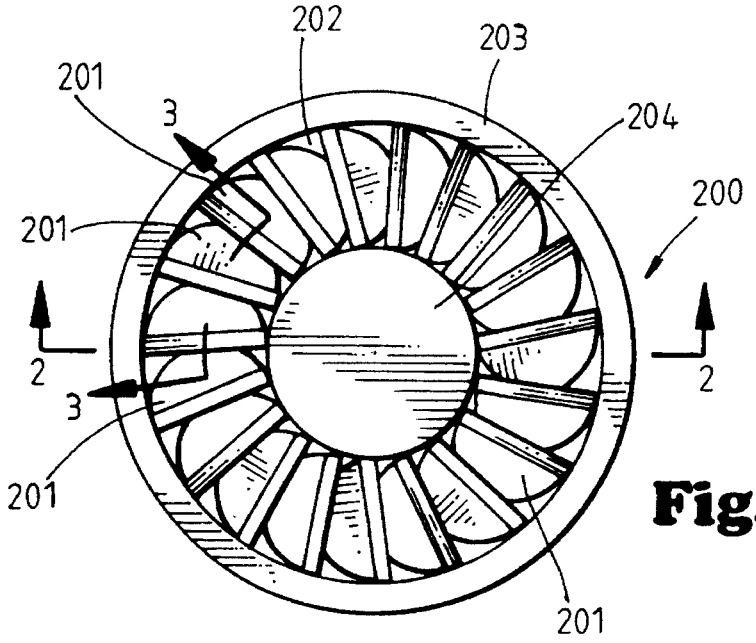
Fig. 1
Fig. 2
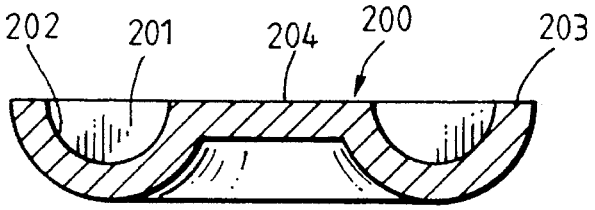
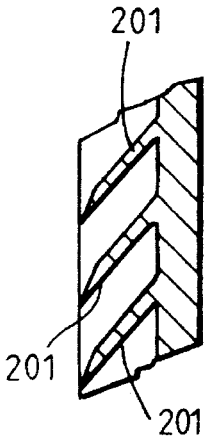
Fig. 3
Fig. 4
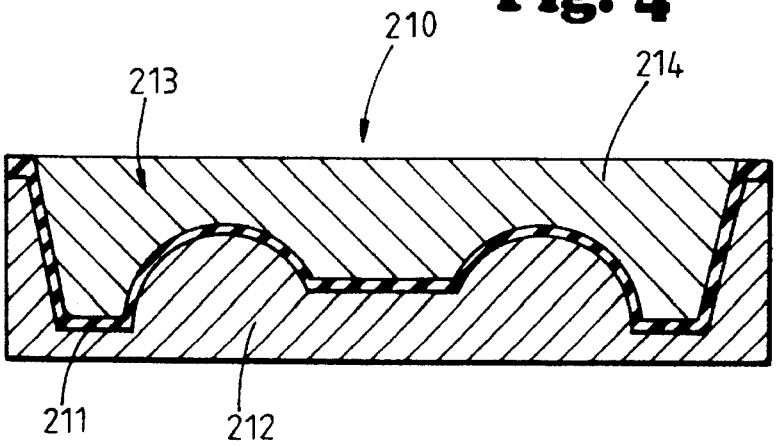

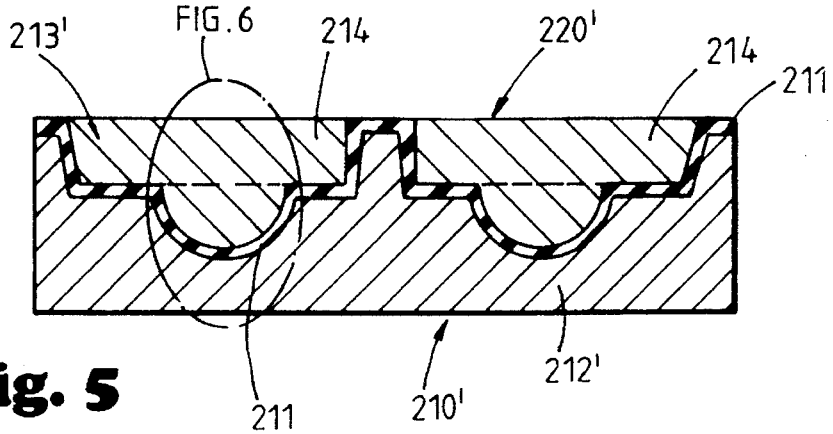
Fig. 5
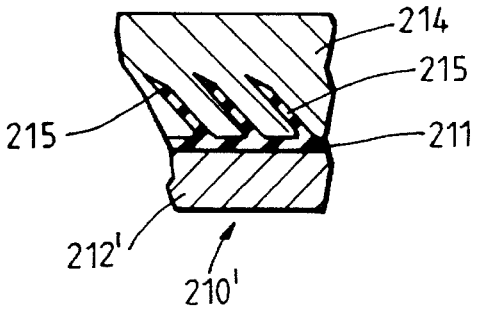
Fig. 6
Fig. 7
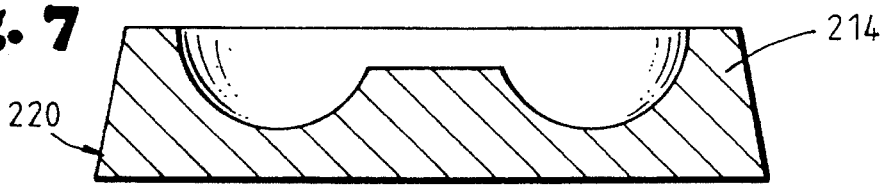
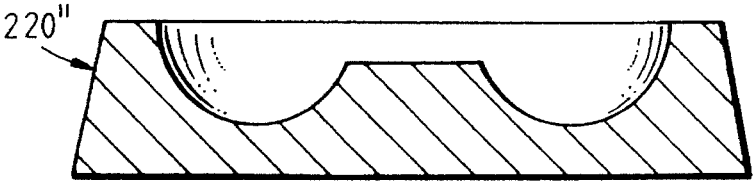
Fig. 7a
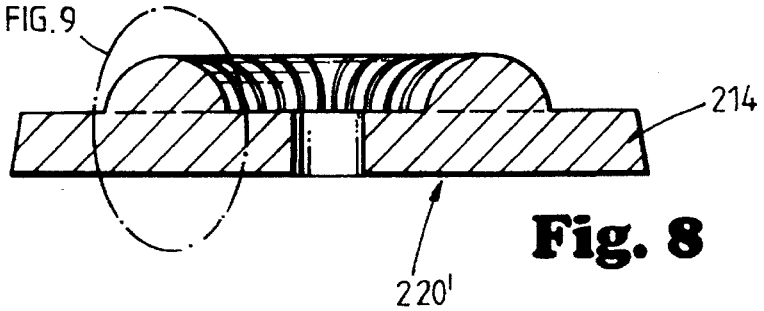
Fig. 8

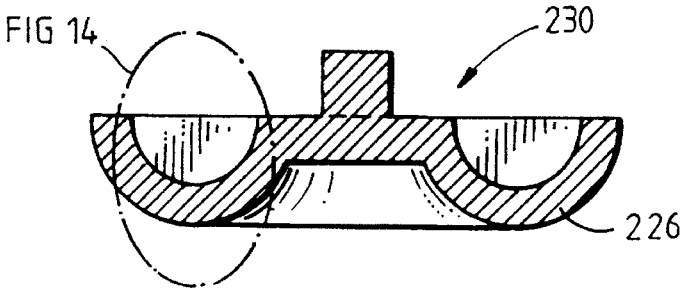
Fig. 13
Fig. 14
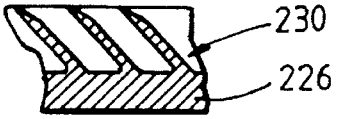
Fig. 15
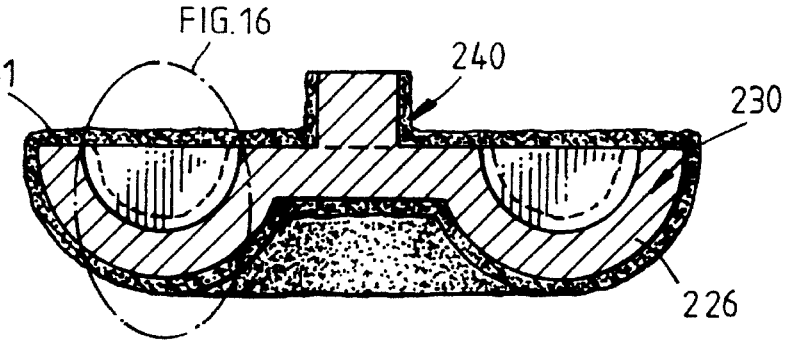
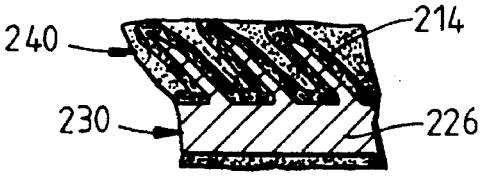
Fig. 16
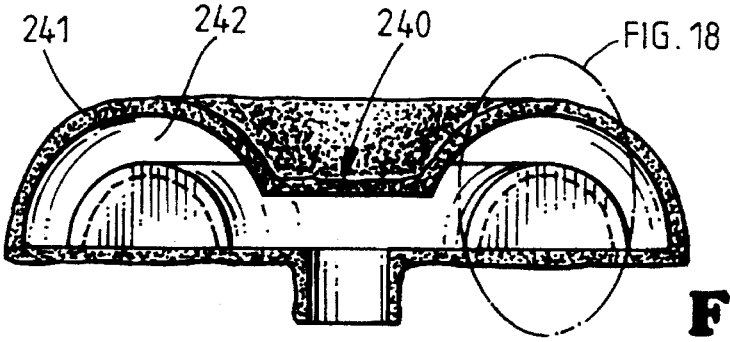
Fig. 17

Fig. 18
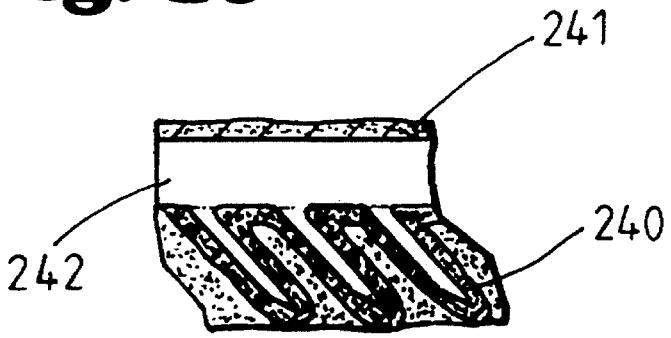
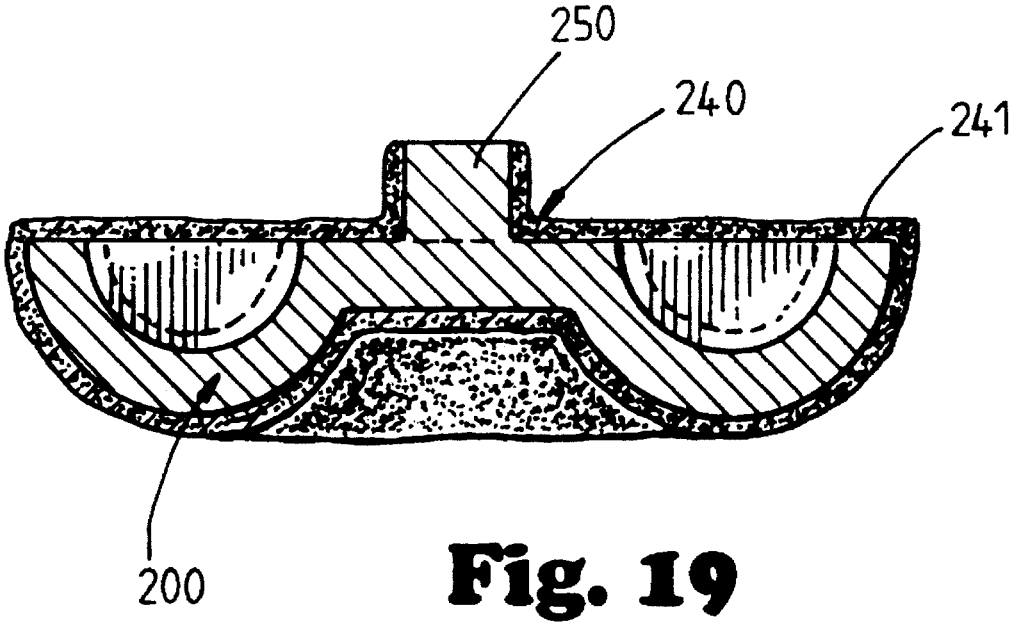
Fig. 19

INVESTMENT CASTING PROCESS

BACKGROUND OF THE INVENTION

1. Field of the Invention

The invention concerns an investment casting process, and in particular an investment casting process wherein a lost pattern is formed in a temporary mold.

2. Description of the Prior Art

The present invention offers substantial improvements in the investment casting processes, those being: "Lost Wax" and "Temporary Pattern" by freezing a liquid in an elastic mold. Both of these processes allow for the manufacture of high quality castings, however, each process presents a number of disadvantages.

The main disadvantages of the "Lost Wax" process originate in the transformation and handling of the used wax for the manufacturing pattern. The high cost of the necessary tooling for the injection of the wax makes this process profitable only for pieces to be manufactured on a large scale. The complexity of the handling of the wax patterns results in a high cost for labor in the preparation of clusters or multiple patterns. There is also difficulty associated with using, and a decline in the quality of, the wax when it is recycled.

When using the "Temporary Pattern" process, wherein the temporary pattern is formed by freezing a liquid in an elastic mold, and the temporary pattern is coated with a ceramic material, the goal is the production of precise parts with thin wall thickness and intricate shapes. Accordingly, the main disadvantages of this process are:

1. the enormous difficulty in the extraction of the temporary pattern from the elastic mold without causing any cracks in the pattern when thin walls must be obtained;
2. the difficulty of manufacturing pieces that require complex cores, which leads to the imperative use of ceramic cores, hence incurring an increase in the price of the final product; and
3. difficulty in the extraction of complete clusters from the elastic mold without causing any cracks.

With the present invention, the foregoing disadvantages of the prior art investment casting processes are overcome and remedied. A precise casting process is provided by means of a ceramic coating of a lost pattern, in which, unlike the prior art processes, the lost pattern is formed in a temporary mold, which may, be partially or totally lost. The present invention provides the following advantageous effects:

1. the manufacture of all types of cast pieces, including those which are extremely thin or that require complex cores, while avoiding both the risk of cracking and the need of using cores during the process of pouring the metal;
2. the manufacture of all types of high quality pieces regardless of their complexity, which can be manufactured in large, medium and short runs, with a minimum investment in tooling which makes for a profitable manufacture of such complex pieces in large, medium and short runs;
3. the manufacture of all types of high quality pieces using recyclable materials in the manufacturing of lost patterns and molds which entails low preparation costs of lost patterns and molds; and 4. the manufacture of all types of high quality pieces even when it is necessary for the preparation of complete clusters (multiple patterns) with no risks of cracks, which entails low handling costs of the lost patterns.

SUMMARY OF THE INVENTION

In accordance with the invention, the foregoing advantages have been achieved through the present method, carried out as specified below, for producing cast pieces by means of ceramic coating of a lost pattern which has been formed in a temporary mold.

Using a positive pattern, the lost parts of the temporary mold are formed by pouring a liquid M over the pattern and cooling it below its melting point to a solid state. The pattern is extracted from the lost parts of the mold and the temporary mold is formed by assembling the lost parts and permanent parts, if permanent parts are used.

The temporary pattern is formed by pouring a second liquid A into the temporary mold and cooling the second liquid A until it reaches a solid state.

The lost parts of the temporary mold are eliminated by melting the lost parts through the adequate control of the temperature, or by dissolving the temporary mold in an adequate solvent, thus obtaining the temporary pattern.

A ceramic coating is then placed around the temporary pattern. The temperature is raised above the melting temperature of material A, in order to cause the melting and evacuation of the temporary pattern, obtaining a ceramic shell whose cavity has the same shape as the piece to be cast.

The cavity of the ceramic shell is filled with molten metal, which is allowed to solidify to form the final piece.

The character of this invention may be better understood by reference to the attached drawings which describe one embodiment of carrying out the invention, in particular the method which entails the removal of the temporary mold by fully melting of the same.

BRIEF DESCRIPTION OF THE DRAWINGS

In the drawings:

FIG. 1 is a top view of a cast piece to be made in accordance with the practice of the method of the present invention, the cast piece having a plurality of blades;

FIG. 2 is a partial cross-sectional view taken along line 2—2 of FIG. 1;

FIG. 3 is a partial cross-sectional view taken along the arc line 3—3 of FIG. 1, illustrating the cross-sectional configuration of the blades of the cast piece;

FIG. 4 is a partial cross-sectional view of a positive pattern used to make a portion of a temporary mold in accordance with the present invention;

FIG. 5 is a partial cross-sectional view of a positive pattern used to make another portion of a temporary mold in accordance with the present invention;

FIG. 6 is a partial, exploded cross-sectional view of the circled portion of FIG. 5;

FIG. 7 is a partial cross-sectional view of a temporary mold in accordance with the present invention, the temporary mold having been made with the positive pattern of FIG. 4;

Figure 9:
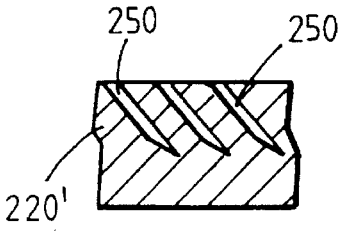
Figure 10:
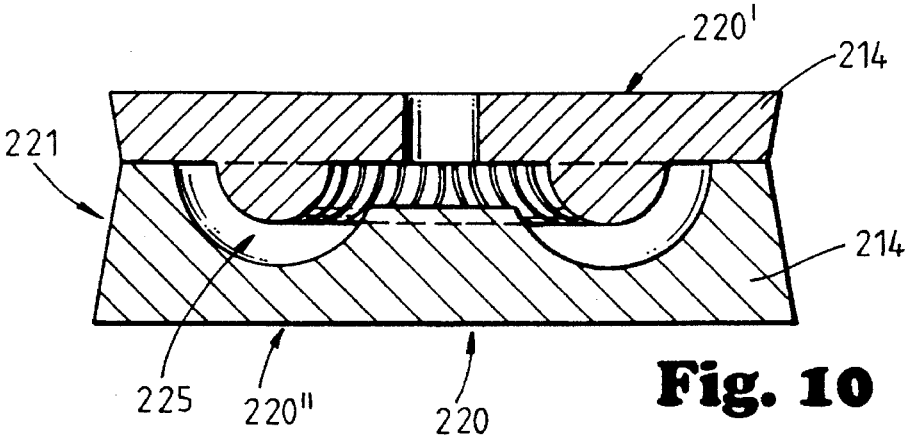
Figure 11:
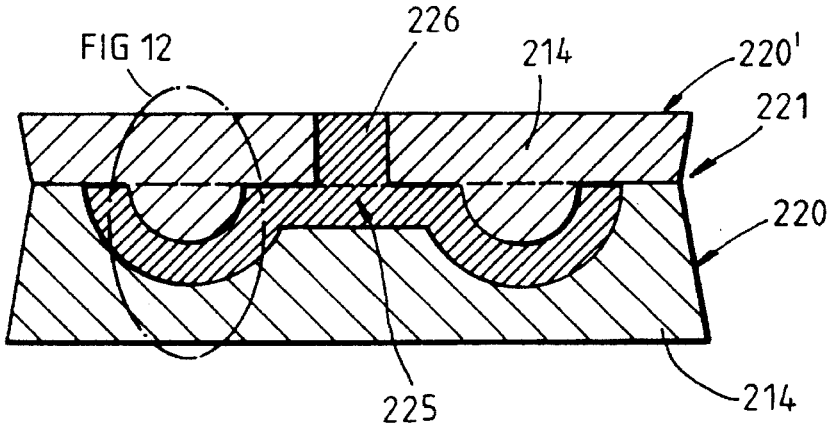
Figure 12:
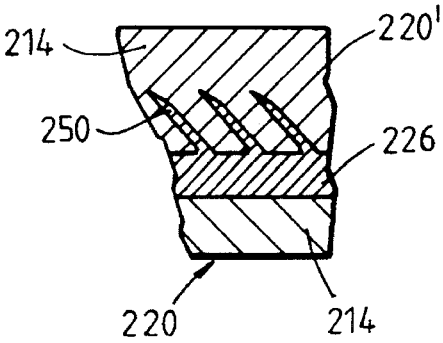

FIG. *7a* is a partial cross-sectional view of a permanent mold in accordance with the present invention;

FIG. 8 is a partial cross-sectional view of a temporary mold in accordance with the present invention, the temporary mold being made with the positive pattern of FIG. 5;

FIG. 9 is a partial, exploded cross-sectional view of the circled portion of the temporary mold of FIG. 8;

FIG. 10 is a temporary mold in accordance with the present invention, formed by the assembly of the temporary molds of FIGS. 7 and 8;

FIG. 11 is the temporary mold assembly of FIG. 10, after pouring a liquid A into the temporary mold assembly of FIG. 10;

FIG. 12 is a partial, exploded cross-sectional view of the circled portion of FIG. 11;

FIG. 13 is a partial cross-sectional view of a temporary pattern formed in accordance with the present invention, the temporary pattern being formed in the temporary mold assembly of FIG. 11;

FIG. 14 is a partial, exploded cross-sectional view of the circled portion of FIG. 13;

FIG. 15 is a partial cross-sectional view of the temporary pattern of FIG. 13 having a ceramic coating thereon to form a ceramic shell;

FIG. 16 is a partial, exploded cross-sectional view of the circled portion of FIG. 15;

FIG. 17 is a partial cross-sectional view of the ceramic shell of FIG. 15 and its cavity formed upon removing the temporary pattern and its evacuation from the ceramic shell;

FIG. 18 is a partial, exploded cross-sectional view of the circled portion of FIG. 17; and FIG. 19 is a partial, cross-sectional view of the ceramic shell mold of FIG. 17 after pouring and solidification of molten metal inside the ceramic shell.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

With reference to FIGS. 1–3, a metallic product, or cast piece, 200 to be manufactured in accordance with the investment casting process of the present invention is illustrated, and includes a plurality of thin blades 201 which are disposed within an annular recess 202 formed in piece 200. Piece 200 includes an outer annular shaped wall 203 and a central flat circular-shaped surface 204. It should be understood that the configuration of the piece 200 shown in FIGS. 1–3, to be manufactured in accordance with the investment casting process of the present invention, is utilized for illustrative purposes only, as a multitude of different shaped pieces 200 can be manufactured through use of the investment casting process of the present invention.

With reference to FIGS. 4–6, the process of the present invention begins with the manufacture of at least one positive pattern 210, having the same configuration as the cast piece 200 to be manufactured. The positive pattern 210 is generally formed by a layer of elastic material 211 which sits up, rigid support piece 212. This pattern 210 may reproduce one or various pieces, depending on the size and shape of the pattern 210. FIG. 4 illustrates pattern 210 used in the process of the present invention and FIG. 5 illustrates another pattern 210'. Primed reference numerals are utilized to designate components having similar construction. Each pattern 210, 210' forms an interior cavity 213, 213'. FIG. 6 illustrates the detail of pattern 210', wherein the elastic material 211 defines a shape 215 associated with the blades 201 (FIGS. 1–3) to be ultimately manufactured.

Liquid M, 214, is poured into the interior of cavities 213, 213' of the different patterns 210, 210', and each assembly of filled cavities 213, 213' are cooled to a temperature T(1), lower than the melting point of liquid M, 214, resulting in the solidification of liquid M, 214. The patterns 210, 210' are then removed, and the frozen liquid M, 214, forms the two parts 220, 220' of a temporary mold 221 as shown in FIGS. 7–9, with cavities 250 having the shape of the blades 201 to be manufactured.

A temporary mold 221 is formed by assembling the temporary mold parts 220, 220', as illustrated in FIG. 10, thus forming an interior cavity 225.

With reference to FIGS. 11 and 12, keeping the temperature at T(1), a liquid A, 226, is poured into the interior cavity 225 of the temporary mold 221. The relation between liquid M, 214, and liquid A, 226, must be the following:

$$T(M)<T(A)$$

where T(M) and T(A) are the melting temperatures of materials M, 214, and A, 226, respectively. Material M, 214, may be an aqueous material, such as water, and material A, 226, may be a low molecular weight paraffin.

Given that the temporary mold 221 is at a temperature T(1) which is lower than the melting point of M, 214, T(M), and, therefore, sensibly lower than the solidification temperature of the liquid A, 226, the solidification of liquid A, 226, will be obtained.

The temperature of the temporary mold 221 is brought to a temperature T(2) between the melting points of materials A, 226, and M, 214, where:

$$T(M)<T(2)<T(A)$$

At this temperature T(2), the melting of the temporary mold 221 is produced, and a temporary pattern 230 remains in a solid state, as shown in FIGS. 13 and 14.

Alternatively, the temporary mold 221 may be dipped, or immersed, in a solvent to dissolve temporary mold parts 220, 220' of temporary mold 221. Material M, 214, should be soluble in the solvent, and material A, 226, should not be soluble in the solvent. Accordingly, the solvent will dissolve temporary mold parts 220, 220' and temporary pattern 230 remains in a solid state as shown in FIGS. 13 and 14. for example, if material M, 214, is an aqueous material, such as water, and material A, 226, is not soluble in the aqueous material, the temporary mold parts 220, 220' may be removed from the temporary pattern 230, by immersing temporary mold parts 220, 220' and temporary pattern 230 into an aqueous material, such as water, which is at a temperature T(2).

As shown in FIGS. 15 and 16, while maintaining the pattern 230 at a temperature lower than T(A), the coating of the temporary pattern 230 is done by dipping pattern 230 into a ceramic slurry 240 whose solidification temperature should be lower than T(A). Other than that requirement, the coating process is carried out by conventional means, known to those skilled in the art. The ceramic slurry solidifies and hardens to form a ceramic shell 241 disposed about the temporary pattern 230.

With reference to FIGS. 17 and 18, the temperature of the temporary pattern 230 and ceramic shell 241 are raised above T(A), the melting point of material A, 226, so that the temporary pattern 230 melts and is evacuated from the interior cavity 242 of the ceramic shell 241 by inverting the position of the ceramic shell 241. If material A is not soluble in an aqueous material, such as water, the temporary pattern 230 may be removed from the interior cavity 242 of the ceramic shell 241 by immersing the ceramic shell into the aqueous material such as water, at a temperature higher than T(A).

The next steps such as: drying of the ceramic shell 241; filling the ceramic shell 241 with molten metal 250 as shown in FIG. 19; allowing the metal 250 to solidify; eliminating the ceramic shell 241 which is stuck to the cast piece 200 (FIGS. 1–3); and eliminating any left over material, such as feeding systems of the pieces, or sprues, may all be carried out by conventional procedures, known to those skilled in the art.

A possible modification to the previous embodiment of the present invention would be the substitution of the total removal of the temporary mold 221 by only the partial removal of the temporary mold 221. This can be achieved by substituting for the temporary part 220 of the mold 221, a permanent part 220" (FIGS. *7a* and 10), as this area of the cast piece 200 does not present any releasing difficulty. In this way a partially lost temporary mold 221' would be obtained, having temporary part 220' as previously described and permanent part 220". The permanent part 220" of temporary mold 221 can be subsequently removed from the temporary pattern 230 by merely removing it from the temporary pattern 230 when the temporary mold part 220' is melted or dissolved as previously described.

The process of the present invention allows the production of all types of top quality cast parts 200 as it makes possible—irrespective of their complexity—forming a lost pattern in a lost mold, thus avoiding the risk of breakage of lost patterns as well as the need of using cores with high deformation risks. In addition readily recyclable materials are used in the production of the lost patterns and molds.

It is to be understood that the invention of is not limited to the exact details of construction, operation, exact materials, or embodiment shown and described as obvious modifications and equivalents will be apparent to one skilled in the art. Accordingly, the invention is therefore to be limited only by the scope of the appended claims.

We claim:

1. An investment casting process for manufacturing a cast piece, comprising the steps of:

(a) forming at least one positive pattern of a portion of the cast piece, the positive pattern having at least one interior cavity;

(b) filling the at least one cavity of the at least one positive pattern with a liquid material M;

(c) cooling the filled positive pattern until the material M reaches a solid state to form a temporary mold part;

(d) removing the positive pattern from the temporary mold part;

(e) forming a temporary mold by assembling at least one temporary mold part;

(f) filling the temporary mold with a liquid material A, wherein the relation between materials M and A is T(M)<T(A), where T(M) and T(A) are the melting point temperatures of materials M and A;

(g) cooling the filled temporary mold until the liquid material A solidifies into a temporary pattern;

(h) removing the temporary mold from the temporary pattern;

(i) coating the temporary pattern with a ceramic coating to form a ceramic shell around the temporary pattern;

(j) removing the temporary pattern from the ceramic shell by evacuating liquid material A from the ceramic shell;

(k) filling the ceramic shell with molten metal and allowing the molten metal to solidify; and (l) separating the ceramic shell from the solid metal.

2. The investment casting process of claim 1, wherein the temporary mold is removed from the temporary pattern by heating the temporary mold and temporary pattern to a temperature T(2), wherein T(M)<T(2)<T(A), to melt the temporary mold.

3. The investment casting process of claim 1, wherein the temporary mold is removed from the temporary pattern by dipping the temporary mold and temporary pattern in a solvent, wherein the material M is soluble in the solvent, and the material A is not soluble in the solvent; and dissolving the temporary mold in the solvent.

4. The investment casting process of claim 1, including the steps of forming at least one permanent mold part, and forming the temporary mold by assembling at least one temporary mold part with at least one permanent mold part.

5. The investment casting process of claim 1, wherein material M is an aqueous material and the material A is not soluble in the aqueous material, and the temporary mold is removed from the temporary pattern by immersing the temporary mold and temporary pattern into the aqueous material which is at a temperature T(2), wherein T(M)<T(2)< T(A).

6. The investing casting process of claim 1, wherein material A is not soluble in water, and the temporary pattern is removed from the ceramic shell by immersing the ceramic shell into water at a temperature higher than T(A).

7. The investment casting process of claim 1, wherein the temporary pattern is removed from the ceramic shell by heating the ceramic shell and temporary pattern to a temperature higher than T(A).

8. The investment casting process of claim 1, including the step of utilizing an aqueous material for material M.

9. The investment casting process of claim 8, wherein the aqueous material M is water.

10. The investment casting process of claim 9, wherein material A is not soluble in water.

* * * * *